United States Patent [19]

Davies et al.

[11] 4,036,046

[45] July 19, 1977

[54] WIRE DRAWING

[75] Inventors: Peter Gough Davies, Cardiff; Keith Thomas Jones, Blackwood; Brian Salmon, Cardiff, all of England

[73] Assignee: GKN Somerset Wire Limited, England

[21] Appl. No.: 681,256

[22] Filed: Apr. 28, 1976

[30] Foreign Application Priority Data

May 7, 1975 United Kingdom ..... 19080/75

[51] Int. Cl.[2] ..... B21C 9/00

[52] U.S. Cl. ..... 72/286; 72/289

[58] Field of Search ..... 72/286, 377, 39, 289

[56] References Cited

U.S. PATENT DOCUMENTS

| | | | |
|---|---|---|---|
| 1,412,979 | 4/1922 | Sundh | 72/39 |
| 1,835,462 | 12/1931 | Busey | 72/286 |
| 2,924,329 | 2/1960 | Compson | 72/342 |
| 2,928,527 | 3/1960 | Frankenfield | 72/289 |
| 3,336,784 | 8/1967 | Campbell et al. | 72/289 |
| 3,774,436 | 11/1973 | Tviksta | 72/286 |
| 3,946,582 | 3/1976 | Pietroni | 72/286 |

*Primary Examiner*—Michael J. Keenan

*Attorney, Agent, or Firm*—Ostrolenk, Faber, Gerb & Soffen

[57] ABSTRACT

An apparatus for wire drawing including a die and a rotatable block around which the wire leaving the die is arranged to be wrapped, a cooling means located between the die and the block for cooling the wire using a coolant and a wiping means for wiping substantially all the liquid coolant from the wire before it passes onto the block. The cooling means is in the form of an elongated chamber through which the wire is arranged to pass while in a substantially straight configuration and moving in the direction of its length. The chamber is provided with nozzles arranged to direct jets of the liquid coolant onto the straight moving wire and with a slot which extends longitudinally from one end of the chamber to the other. A deformable baffle which forms part of the wall of the chamber extending across this slot and allows a substantially straight length of wire to be inserted into and withdrawn from the chamber through the slot by movement of the straight length relative to the chamber in a direction substantially at right angles to the longitudinal axis of the straight length thus deflecting the baffle.

22 Claims, 10 Drawing Figures

FIG.1.
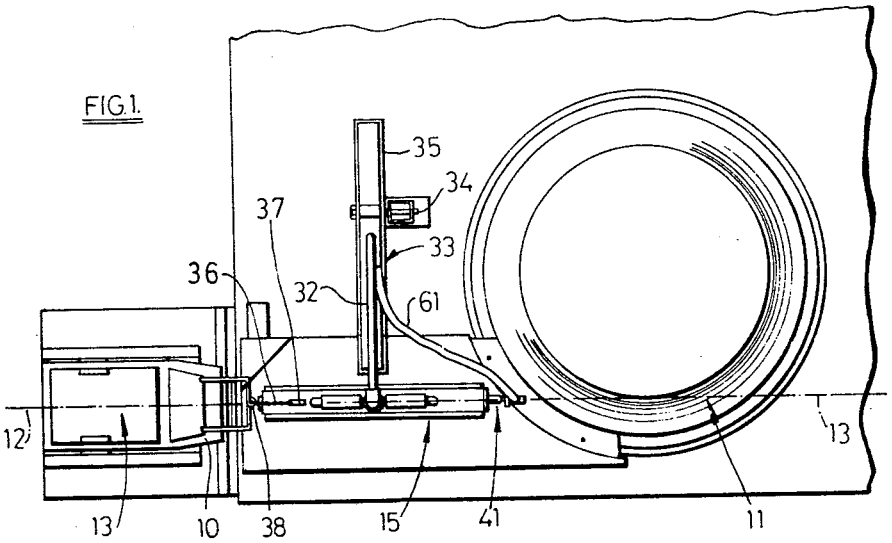
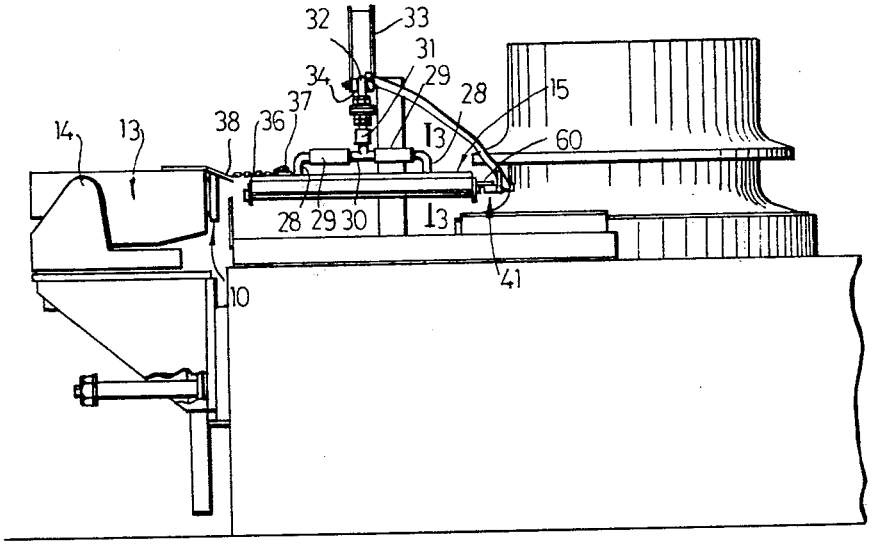
FIG.2

WIRE DRAWING

BACKGROUND OF THE INVENTION

This invention relates to the drawing of wire. Wire is made by drawing down rod and hereinafter rod, partly drawn rod and finished wire are all referred to, for convenience, as a metal filament.

Conventionally, steel wire is drawn from a steel rod by passing it in succession through a number of dies or "holes". The number of dies through which the metal filament is passed will depend on the difference in sizes between the starting rod and the finished wire and also on the draft in each die. A conventional continuous wire-drawing machine may have any number between four, and twelve dies and between each pair of successive dies there is provided a rotating capstan or block which pulls the metal filament through the preceding die and accumulates the metal filament thereon. It will be appreciated that as the metal filament decreased in cross-sectional area so it will increase in length and the blocks will be driven at increasing speeds with the decrease in cross-section of the metal filament.

It is important in the manufacture of wire from many metals, and particularly in the manufacture of steel wire, to prevent the temperature of the metal filament from increasing to such a value that the properties of the wire are adversely affected by strainage hardening which is a time/temperature effect and which decreases the ductility of the filament, particularly the torsional ductility although the longitudinal ductility also decreases, while at the same time increasing the ultimate tensile strength.

In steel wire drawing, the metal filament at each stage of drawing passes through a soap box where a drawing soap is applied to the surface of the filament. The filament then passes through the die and in its passage therethrough is lubricated by the soap which it has previously picked up. From the die, the filament passes to the block which succeeds the die and a number of turns of the filament are built up on the block before the filament passes to the next soap box, die and block.

Conventionally, the blocks of a wire-drawing machine are internally cooled by circulating water through them, the water serving indirectly to cool the filament. Moreover, the more turns of the filament on a block, the longer time has the filament to cool and the better can the temperature be controlled. However, it is necessary to treat the water to prevent it scaling the surface of the passages in the block and the water has to be kept clean otherwise it becomes contaminated. Both scale and scum can reduce the heat transfer through the walls of the block and thus decrease the effeciency of the cooling. Moreover it is necessary to provide a comparatively expensive water treatment and cooling plant to ensure that the water is adequately cooled and that it is free of scum and that it will not scale the inner surface of the block.

It has been found, in practice, that this indirect cooling merely by passing water through internal passages in the blocks is insufficient to keep the temperature of a steel filament below that at which it is damaged by strainage hardening, especially with the increasing speeds of wire drawing which are not being used and with the increasing use of controlled cooled rods rather than lead-patented rods. Obviously it is preferable from a production point of view to be able to increase the speed of drawing but, on the other hand, the higher the speed of drawing the more heat is generated in a given time and the more the filament has to be cooled. Moreover, a lead-patented material can withstand higher temperatures during drawing without deleteriously affecting the properties of the finished wire than can material which has been drawn from controlled-cooled rod. This is because the pearlitic spacing of the lead-patented rod is finer than that of the controlled-cooled rod. Increasing use is being made of controlled-cooled rods because they save an expensive heat treatment operation and therefore it is becoming even more important to control the temperature of the filament being drawn both because of the increasing use of the controlled-cooled rod and because of the increasing speed of wire drawing.

A solution is therefore required to the problem of maintaining the filament at a low temperature during drawing so as to control the strainage hardening which occurs, particularly with high carbon steel wire. We have above been referring specifically to the drawing of steel wire but the problem arises in connection with the drawing of any metal filament where the finished wire is deleteriously affected by heat. It is pointed out, however, that there are some materials, for example tungsten, where it is advantageous to draw the metal hot and of course the present invention is not concerned with the drawing of such materials unless the drawing temperature reaches such a value as deleteriously to affect the mechanical properties of the finished wire.

It is an object of the present invention to provide an apparatus for wire drawing and a method of wire drawing which is simple, comparatively inexpensive and which enables the temperature of the filament being drawn to be readily controlled.

SUMMARY OF THE INVENTION

According to a first aspect of the invention we provide apparatus for wire drawing comprising a die and a rotatable block around which the filament leaving the die is arranged to be wrapped, the apparatus including means located between the die and the block for cooling the filament using a liquid coolant and a wiping means for wiping substantially all the liquid coolant from the filament before the latter passes onto the block, said cooling means comprising an elongated chamber through which the filament is arranged to pass whilst in a substantially straight configuration and moving in the direction of its length, said chamber being provided with nozzles arranged to direct jets of the liquid coolant onto the straight moving filament and with a slot which extends longitudinally from one end of the chamber to the other, a deformable baffle which forms part of the wall of the chamber extending across said slot and the arrangement allowing a substantially straight length of filament to be inserted into and withdrawn from the chamber through said slot by movement of said straight length relative to the chamber in a direction substantially at right angles to the longitudinal axis of said straight length thus deflecting said baffle.

We have found that, using apparatus as described in the preceding paragraph in which the filament is directly cooled by liquid coolant it is possible to operate at significantly higher drawing speeds without deleteriously affecting the mechanical properties of the drawn filament than is possible using conventional apparatus in which the filament is cooled solely by internally cooled drawing blocks as described above.

By providing the cooling chamber with the slot and baffle it is possible to get the apparatus quickly back into operation, should the filament break during drawing by passing the wire through the baffle as described above. This obviates the need to thread the filament through the cooling chamber thus removing the need to taper the end of the filament which might otherwise be necessary if the filament needed to be threaded through the chamber. Also, by cooling the filament whilst it passes through the elongated chamber it is possible to prevent the coolant being thrown about in the surrounding atmosphere.

Other advantages of the present invention will be referred to later.

In a preferred arrangement the liquid coolant is arranged to drain from the chamber via the deformable baffle. The chamber may comprise an inverted channel with the downwardly directed mouth of the channel forming the slot. In such an arrangement the baffle prevents the coolant falling directly from the filament and promotes turbulent flow of the coolant in the chamber thus increasing the cooling effect. The baffle may comprise a pair of brushes arranged to extend towards each other from oppsoite sides of said slot.

The nozzles may be of elongated form and may extend parallel to the length of the straight moving filament and may discharge jets of liquid coolant onto the filament at substantially diametrically opposed positions.

The end of the chamber may be provided with V-shaped guides to locate the straight moving filament relative to the coolant jets.

The cooling means may be suspended from a position above the filament by a counterbalanced arm. The cooling means may be prevented from moving longitudinally of the filament by means which releasably secure it to a die box which supports the die from which the filament issues. Such means may comprise a hook on the die and a chain secured to the cooling means and engaging the hook. The cooling means may be supported from the arm by a hose which delivers the cooling liquid to the jets. Typically the apparatus will be operated at coolant pressures of 15 to 40 p.s.i.g. at locations immediately upstream of the nozzles.

Preferably, the wiping device is in the form of an air wipe. Such wiping devices are known but normally the aperture through which the filament passes and also which receives the blowing air is of considerably greater diameter than the filament. It is a feature of the present invention that the filament passes through at least two apertures in series, air at super-atmospheric pressure being supplied to a manifold between the apertures and the apertures being of a diameter which is not less than 0.002 inch nor preferably more than 0.020 inch greater than the filament. Preferably the second aperture through which the filament passes is longer, in the direction of travel of the filament, than the first aperture. This means the second aperture presents a greater restriction to air flow than the first aperture so that most of the air and liquid on the entering filament is discharged backwards, i.e. in a direction opposite to the direction of travel of the filament, through the first aperture.

Preferably, the filament passes through three such apertures all falling within the size limits mentioned above. The extra aperture is arranged before the two first-mentioned apertures in the direction of travel of the filament, and is not supplied with air. The extra aperture has the job of physically removing excess liquid from the filament. Preferably, the first aperture which is supplied by air has, upstream of it in the direction of travel of the filament, a hood which extends over the filament and directs any liquid delivered by said first aperture downwardly thus preventing the liquid spraying in all directions into the surrounding atmosphere.

Preferably, the air wipe device is carried by the cooling means.

The apertures through which the filament passes in the air wipe device may be provided in a body portion of the device which is split longitudinally into two pieces in order to allow the filament to be inserted into the device.

In accordance with a second aspect of the present invention we provide a method of wire drawing wherein a metal filament is:

1. passed through a die and then onto a rotating block from which it passes to another die or to a haul-off capstan for finished wire;

2. cooled after leaving the die but before passing onto and being wrapped around the block, when in a straight configuration and moving rectilinearly in the direction of its length, by running through jets of liquid coolant directed at the filament, the velocity and/or pressure of the jets being sufficient to preclude the formation of a continuous vapour blanket around the filament which would prevent the liquid contacting the surface of the filament;

3. subsequently passed through a wiping device to remove substantially all of the liquid, and 4. passed onto the block and retained on the block so that each successive length of the filament is allowed a sufficient time to finish drying before passing to the next drawing stage or to the haul-off capstan.

The jets of coolant may be directed at the filament whilst it passes through an elongated chamber provided with a slot and deformable baffle as described above.

The jets of coolant may issue from elongated nozzles arranged to extend parallel to the length of straight filament being cooled and disposed on opposite sides of the filament at substantially diametrically opposed positions.

The invention also provides a cooling means and a wiping device for use in apparatus in accordance with the first aspect of the present invention.

BRIEF DESCRIPTION OF THE DRAWINGS

The invention will now be described in detail by way of example with reference to the accompanying drawings in which:

FIG. 1 is a plan view of one stage of a wire drawing apparatus embodying the invention;

FIG. 2 is an elevation of the apparatus shown in FIG. 1;

DESCRIPTION OF A PREFERRED EMBODIMENT

Figure 3:
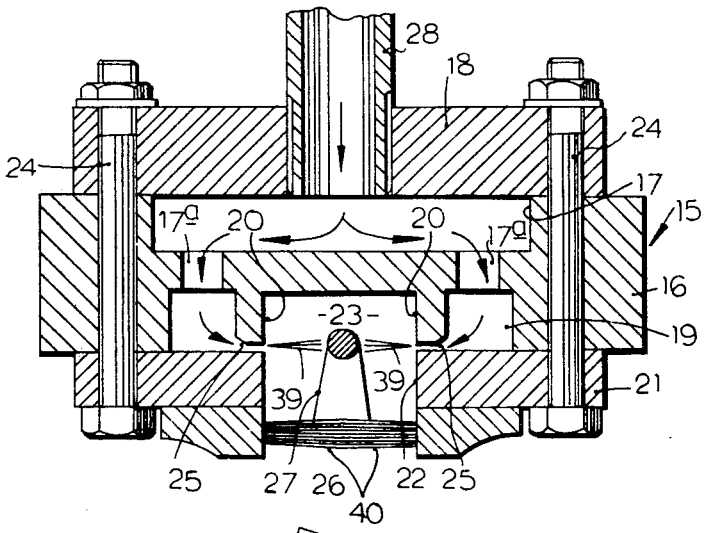
FIG. 3 is a cross-section on a line 3—3 of FIG. 2 through the housing of the cooling device.

Referring first to FIGS. 1 and 2, the apparatus there shown includes a die indicated generally at 10 and a rotating block at 11. A metal filament, which may be in the form of rod or partly drawn rod, follows the line 12 and passes through the die 10 onto a block 11. The filament is wound a number of times around the block 11 before leaving the block along the line 13 to pass to the next die of the apparatus. Before entering the die 10, the filament passes through a soap box 13 forming part of the die assembly which is pivotally mounted on upstanding lugs 14.

While passing between the die 10 and the block 11, the filament is cooled by being passed through a housing indicated generally at 15 and shown in cross-section in FIG. 3. Referring to that Figure, the housing comprises an elongated machined block 16 which has a longitudinal recess 17 in its upper surface which is closed by a cover plate 18. A longtudinal recess 19 is formed in the lower surface of the block and the recess is provided with a pair of spaced, downwardly extending ribs 20. The recesses 17 and 19 are placed in communication by a series of longitudinally spaced apertures 17*a*. The recess 19 is partially covered by a plate 21 having a slot 22 therein which is aligned with the space 23 in the recess 19 between the ribs 20. The slot 22 and space 23 together form an inverted channel-shaped cooling chamber whose mouth extends downwardly. The cover plate 18, the block 16 and the plate 21 are held together by a longitudinal series of bolts, two of which are indicated at 24.

Between the ribs 20 and the upper surface of the plate 21 there are provided two longitudinally extending slit-like nozzles 25 as will be described below, water is caused to flow out of these nozzles to impinge upon opposite sides of a filament which is indicated at 26. The housing 15 rests on the filament and is supported, at its ends, by V-shaped guides 27 which rest on the filament.

Water is supplied to the recess 17 via two L-shaped pipes 28, shown in FIG. 2, which are connected by lengths of hose 29 to a T-piece 30. The T-piece 30 is again connected by a length of hose 31 to a generally horizontal pipe 32 which is carried by an arm 33. The arm is pivoted about horizontal axis at 34 intermediate the ends thereof and the part 35 of the arm on the side of the pivot 34 remote from the housing 15 acts as a counterbalance and may carry counterbalance wights, not shown, so as to adjust the load placed on the filament by the housing. The housing is prevented from moving in the direction of movement of the wire by means of a chain 36 which has one end secured to an eye 37 on the upper part of the housing and at its other end engages a loop 38 carried by the die box assembly.

Water supplied along the pipe 32 flows along the pipes 28 into the recess 17 and then through the holes 17*a* into the recess 19. The water then issues as two thin and very wide jets indicated at 39 so as to impinge upon opposite sides of the filament 26, the jets being directed substantially perpendicularly to the filament. The water is prevented from passing straight out of the chamber formed by the space 29 and the slot 22 by means of a deformable baffle arrangement comprising two brushes 40 which are secured to the plate 21. The brushes serve to restrict the flow out of the bottom of the chamber but are of course deformable so that the casing can be lowered onto the filament in a direction substantially at right angles to the longitudinal axis of the filament.

Figure 4:
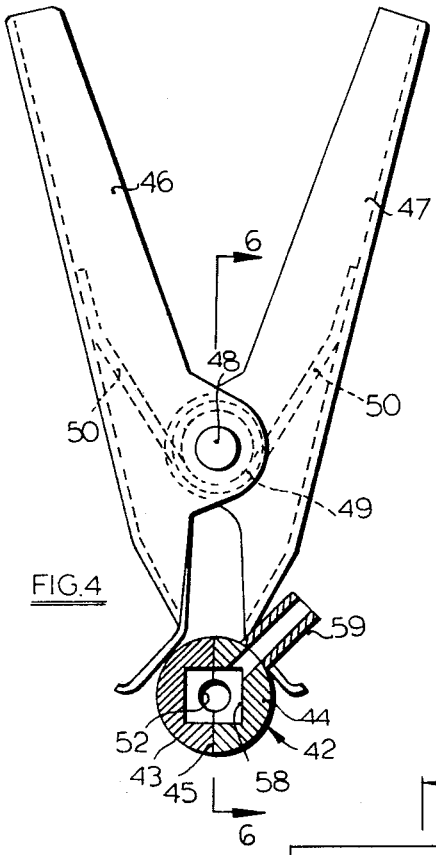
FIG. 4 is an end view of the air wipe device shown in FIGS. 1 and 2 taken on the line 4—4 of FIG. 6.
Figure 5:
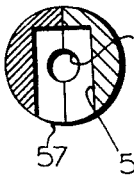
FIG. 5 is a cross-section through the air wipe device taken on the line 5—5 of FIG. 6.
Figure 6:
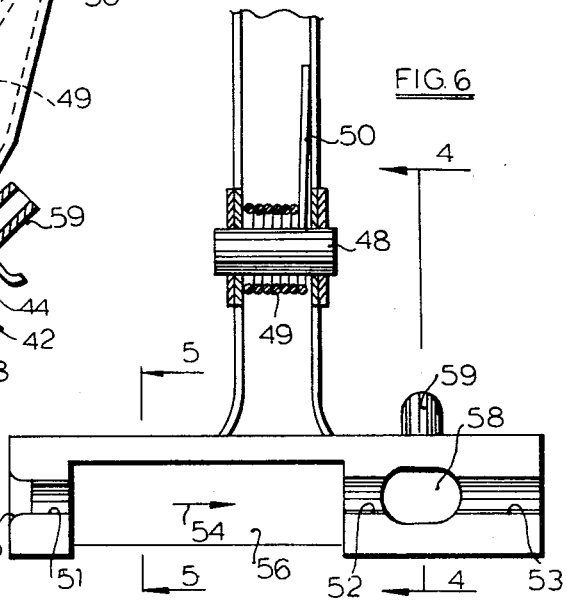
FIG. 6 is a sectional view of the air wipe device taken on the line 6—6 of FIG. 4.

At the right hand end of the housing 15 in FIGS. 1 and 2 there is arranged an air-wipe indicated generally at 41 and shown in detail in FIGS. 4 to 6.

The air wipe comprises a body indicated generally at 42 and formed from two similar halves 43 and 44 which, in the operative position of the air wipe, meet along a face 45. The halves 43 and 44 are secured respectively at the ends of arms 46 and 47 which are pivoted together by a pivot pin 48 which is surrounded by a spring 49 having limbs 50 which engage the arms 46 and 47 to urge them to the positions shown in FIGS. 4 to 6 in which the halves 43 and 44 engage along the face 45.

In this position, the body presents three apertures through which the filament passes. There is a first aperture 51 and second and third apertures 52 and 53. The direction of advancement of the filament in FIG. 6 is indicated by the arrow 54 and the aperture 51 has at the end which is first entered by the filament, a lead-in portion 55. Between the apertures 51 and 52 there is provided a slot 56 which, as shown in FIG. 5, has a mouth 57 which is directed downwardly. Between the apertures 52 and 53 is a manifold 58 which is connected to an air inlet pipe 59 so that air can be supplied to the manifold 58 and flow out through the apertures 52 and 53. It will be noted that the aperture 53 is longer, in the direction of filament advancement, than is the aperture 52.

The air wipe is secured to the right hand end of the housing 15 in FIGS. 1 and 2 by means of a bracket 60 and the pipe 59 is connected by a flexible air hose 61 to a source of compressed air, not shown.

The apparatus operates as follows. Prior to the filament being led through the die 10 and onto the block 11, the housing 15 and the air wipe 41 are lifted by means of the arm 33 out of the path of the filament. Once the filament has been taken around the block 11, the housing 15 is lowered onto the filament so that the V-shaped guides 27 rest on the filament. The counterbalance on the arm is arranged so as not to apply an undue load to the filament. As the housing 15 is lowered, the wire passes between the brushes 40 into the chamber constituted by the slot 22 and the space 23 and the arms 46 and 47 of the air wipe are pivoted so as to move the halves 42 and 43 apart to allow the wire to be received in the apertures 51, 52 and 53 as the arms 46 and 47 are released and the spring 49 returns the arms to the positions shown in the drawing.

When the machine is running and the filament is passing through the die 10 onto the block 11, cooling water is supplied along the pipe 32 and pipes 28 into the upper recess 17 in the housing. As described the water then passes through the apertures 17*a* and forms the two jets 39 which impinge on the filament. The velocity and/or pressure of the water being directed onto the filament is such as to prevent the formation of any steam blanket around the filament which would prevent efficient cooling of the filament by the water. We have found that a pressure of at least 15 p.s.i. is normally required to obtain efficient cooling. Typically the apparatus is operated with the water pressure in the range 30 to 40 p.s.i.

The filament leaves the right hand end of the housing 15 and then passes in succession through the apertures 51, 52 and 53 of the air wipe. During operation air is supplied at a pressure of about 10 p.s.i. to the manifold 58. The apertures, particularly the apertures 52 and 53, are sized so that there is a small clearance between the apertures and the filament. The diameters of the apertures 52 and 53 should have a size not less than 0.002Δ nor preferably more than 0.020Δ greater than the diameter of the filament being treated. Preferably the aperture 51 is of the same size. The aperture 51 serves to remove excess water which is on the surface of the filament and to contain the air/water mixture issuing from the aperture 52. The air supplied to the manifold 58 is given a high velocity by the narrow annulus and blows water off the surface of the wire and this water is delivered mainly from the aperture 52 since this provides a lesser restriction to flow than does the aperture 53 because the aperture 52 is shorter than the aperture 53. Water discharged rearwardly, i.e. in a direction opposite to the arrow 54, into the slot 56 is directed downwardly by the walls and top of the slot which, in effect, act as a hood to direct or deflect the water in the desired direction.

As the filament leaves the aperture 53, it is substantially dry although it is possible that there may be a little moisture left on the filament. The filament then passes onto the block 11. The method is so carried out that there is sufficient residual heat in the filament that, while it is on the block, it can completely dry before leaving the block along the line 13 to pass to the next die. Normally, the block 11 will be cooled as usual and, if desired, an air stream may flow over the filament as is provided in some wiring drawing machines while the filament is on the block. It may, however, in some case be desirable to omit cooling of the block or even to heat the block if there is insufficient residual heat in the filament to completely dry before passing onto the next stage of drawing.

Essentially, therefore, the method involves impinging a cooling liquid, normally water, onto the filament while it is passing in a straight line, removing the majority of the liquid by a wipe, conveniently an air wipe, and then passing the filament onto the block on which it is completely dried before passing to the next stage of drawing or, if the cooling is provided in association with the last die of the machine, before passing onto the haul-off capstan.

In the apparatus described above it will be seen that the filament can be positioned in the cooling chamber and in the air wipe device without the need to thread the end of the filament through either. This, as referred to above, greatly simplifies the setting up of the apparatus for operation and also enables the apparatus to be speedily brought back into operation should the filament break during drawing.

Also, since the cooling chamber is separated from the exit side of the drawing die, should the filament break, the coolant will not flow from the cooling chamber through the die and hence into the associated die soap box thus ruining the die lubrication.

By spacing the air wipe device from the cooling chamber the tendency for the super-atmospheric air to enter the exit end of the cooling chamber is obviated, and hence the efficiency of the coolant at the exit end of the cooling chamber is not reduced by this effect.

Various modifications may be made to the invention as specifically described. Thus in some machines, the filament will pass onto one block and then around a transfer pulley onto another block before passing to the next die.

In such a machine the cooling is preferably between the die and the first block.

Figure 9:
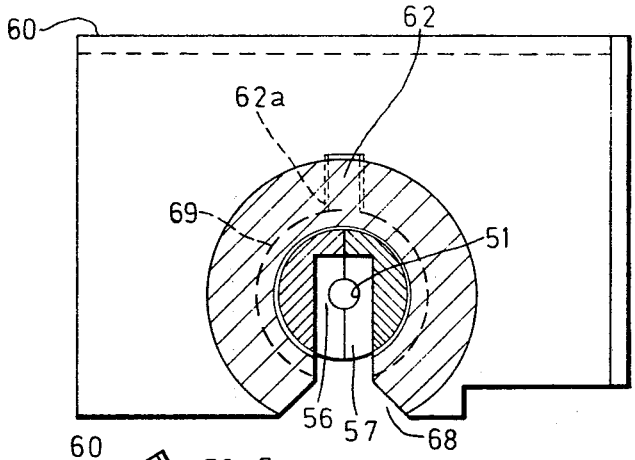
FIG. 9 is a sectional view on the line 9—9 of FIG. 7.
Figure 8:
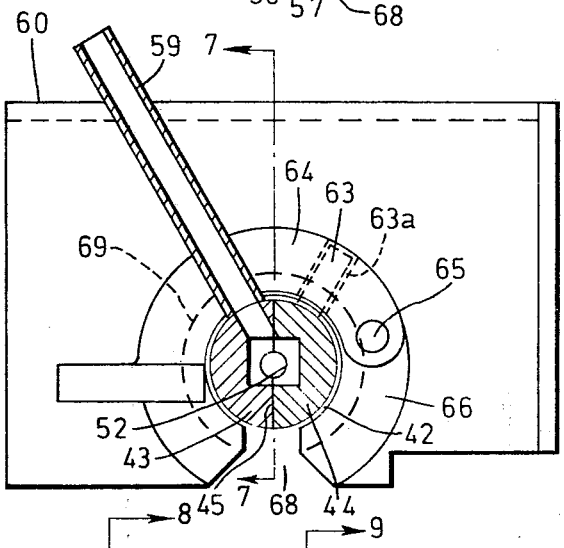
FIG. 8 is a sectional view on the line 8—8 of FIG. 7.
Figure 7:
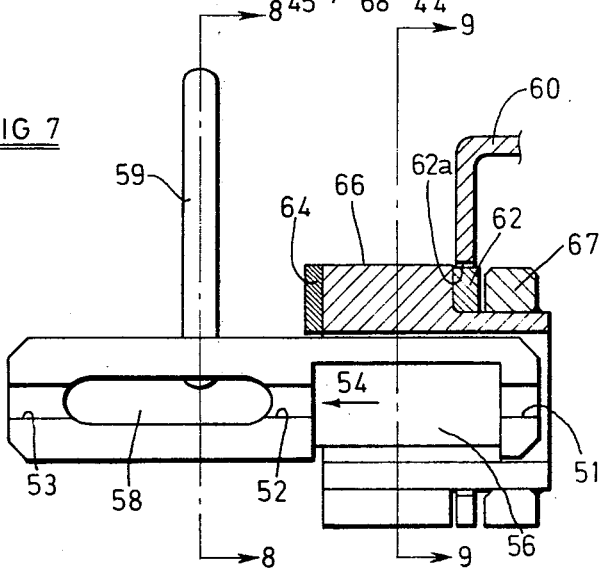
FIG. 7 is a cross-section through an alternative air wipe device on the line 7—7 of FIG. 8.

FIGS. 7 to 9 show an alternative form of air wipe device in which components which have a similar function to the components previously described with reference to FIGS. 4 to 6 have been similarly numbered.

In the arrangement shown in FIGS. 7 to 9 the main body of the device is again in two halves 43 and 44 which co-operate to provide the three apertures 51, 52 and 53 in series. These halves are located relative to each other by any suitable means such as interengaging dowel pins and sockets on the two halves.

The main body, when in assembled relation, is a close fit in a sleeve-like bush 66 being slid into the bush from its left hand end as shown in FIG. 7. The half 44 is provided with a projecting pin 63 which engages a slot 63*a* in the bush 66 in order to retain the mouth 57 of the two halves 43 and 44 in alignment with a mouth in the form of a slot 68 provided in the bush 66.

The pin 63 is retained in the slot 63*a* by a latch 64 which is pivoted on the bush 66 at 65. When in the position shown in FIGS. 7 and 8 the latch closes the open left hand end of the slot 63*a* thus preventing the main body of the device leaving the bush.

The bush 66 is a loose fit in an aperture 69 in a shield 60 which is secured to the right hand end of the housing 15 of FIGS. 1 and 2. A pin 62 on the bush 66 engages a slot 62*a* in the shield 60 and hence prevents rotation of the bush 66 relative to the shield and a collar 67 locates the bush axially in the shield.

The alternative air wipe device described above operates as follows. As the cooling housing 15 is lowered, the filament passes through the brushes 40 into the cooling housing 15 and also through the mouth 68 of the bush 66. The two halves 43 and 44 of the main air wipe body are then placed around the filament in assembled relation and are slit into the bush 66. The latch 64 is then rotated to the position shown in FIGS. 6 and 7 in which the pin 63 is retained in the slot 63*a*. The air wipe device is then ready for use in the same manner as the device previously described with reference to FIGS. 4 to 6.

Figure 10:
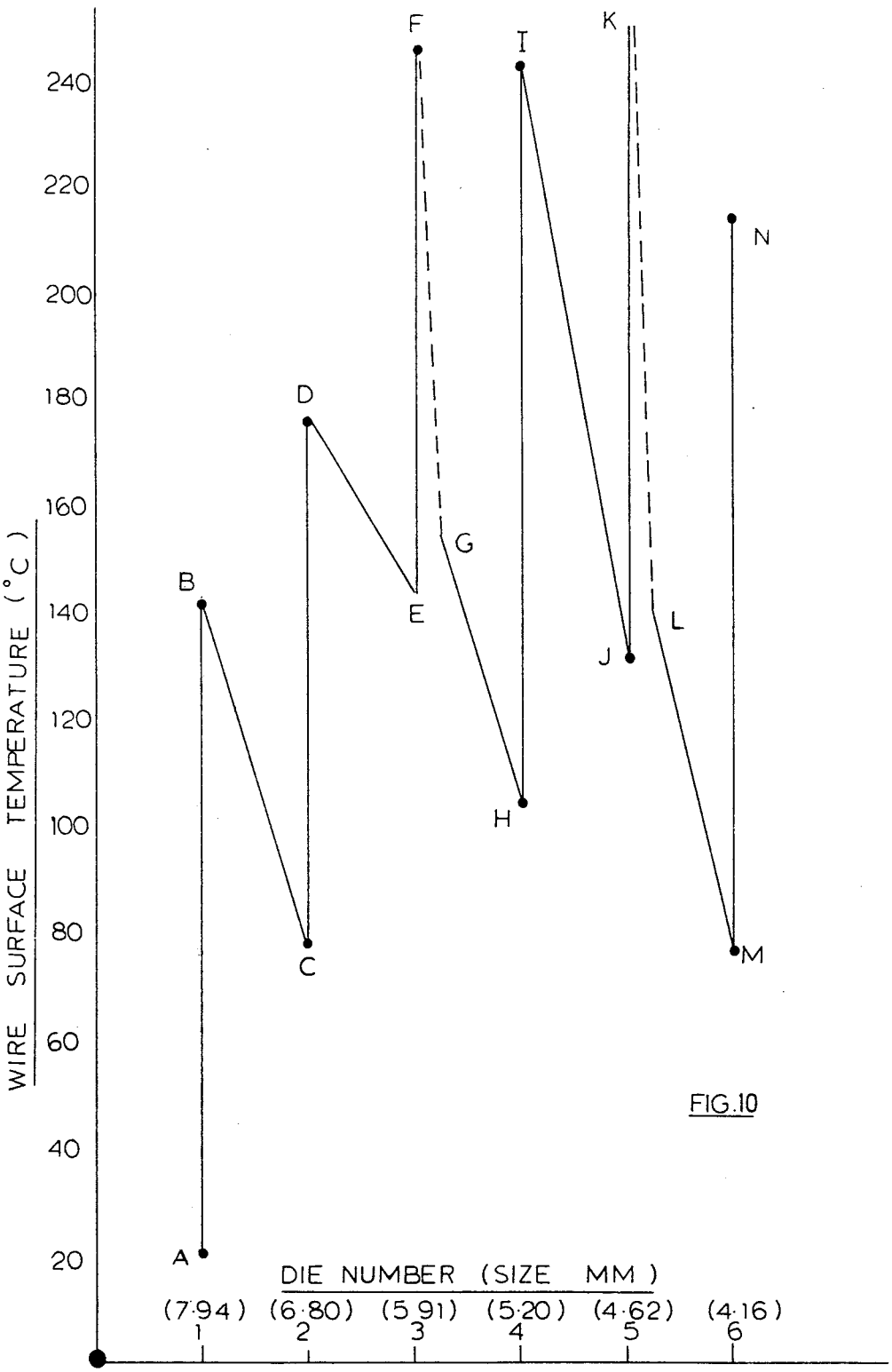
FIG. 10 is a graphical representation of the change in the surface temperature of a filament as it passes through a typical apparatus embodying the invention.

FIG. 10 shows graphically the change in the surface temperature of a filament whose carbon content is 0.78 percent and whose starting size is 9 m.m. as it passes through an apparatus in accordance with the invention which employs six dies in series with a drawing block between each die. The finishing speed of the filament was 1020 feet/minute. In this apparatus the drawing blocks associated with all the dies are internally cooled and the filament leaving the third and fifth dies is also directly cooled by liquid jets using a cooling means of the form described above.

The sections AB, CD, EF, HI, JK and MN of the graph show the temperature rises as the filament passes through the six dies. Sections BC, DE, GH, IJ and LM show the cooling effect of the internally cooled drawing blocks between the dies and sections FG and KL show the additional cooling of the wire leaving the third and fifth dies respectively.

Experience has shown that the drawing speed can be 50 percent higher using the six die apparatus referred to above in relation to FIG. 10 compared with a six die arrangement in which the cooling is provided solely by the internally cooled drawing blocks without deleteriously affecting the mechanical properties of the finished wire. Also, tests on an apparatus which employs four dies in series with internally cooled drawing block between the dies have shown that by cooling the filament leaving one of the dies using liquid jets in a cooling means of the form described above a 40 percent increase in drawing speed is possible, compared with the same arrangement in which only internally cooled drawing blocks are used, without deleteriously affecting the mechanical properties of the finished wire.

It will be seen that the invention provides a simple method and comparatively inexpensive apparatus for cooling a filament during wire drawing which allows higher drawing speeds to be obtained than previously without deleteriously affecting the mechanical properties of the finished wire. The invention is applicable particularly to high carbon steel wires which must have their temperature controlled during drawing but is also applicable to other materials where an excess temperature would deleteriously affect the properties of the finished wire.

We claim:

1. Apparatus for wire drawing comprising a die and a rotatable block around which the filament leaving the die is arranged to be wrapped, the apparatus including means located between the die and the block for cooling the filament using a liquid coolant and a wiping means for wiping substantially all the liquid coolant from the filament before the latter passes onto the block, said cooling means comprising an elongated chamber through which the filament is arranged to pass whilst in a substantially straight configuration and moving in the direction of its length, said chamber being provided with nozzles arranged to direct jets of the liquid coolant onto the straight moving filament and with a slot which extends longitudinally from one end of the chamber to the other, a deformable baffle which forms part of the wall of the chamber extending across said slot and the arrangement allowing a substantially straight length of filament to be inserted into and withdrawn from the chamber through said slot by movement of said straight length relative to the chamber in a direction substantially at right angles to the longitudinal axis of said straight length thus deflecting said baffle.

2. Apparatus according to claim 1 in which the liquid coolant is arranged to drain from the chamber via the deformable baffle.

3. Apparatus according to claim 1 in which the chamber comprises an inverted channel and the downwardly directed mouth of the channel forms said slot.

4. Apparatus according to claim 1 in which the baffle comprises a pair of brushes arranged to extend towards each other from opposite sides of said slot.

5. Apparatus according to claim 1 in which the chamber is provided with two elongated nozzles arranged to extend parallel to the length of the straight moving wire and to discharge jets of liquid coolant onto the wire at substantially diametrically opposed positions.

6. Apparatus according to claim 1 in which the ends of the chamber are provided with V-shaped guides to locate the straight moving wire relative to the coolant jets.

7. Apparatus according to claim 1 in which the cooling means is arranged to be suspended from a position above the filament by a counter-balanced arm.

8. Apparatus according to claim 1 in which the cooling means is arranged to be releasably secured to a die box which supports the die so as to prevent movement of the cooling means longitudinally of the filament.

9. Apparatus according to claim 1 in which the wiping means is an air wipe device comprising two apertures in series through which the filament is arranged to pass, air at super-atmospheric pressure being arranged to be supplied to a manifold between the apertures and to leave the device via the apertures which are between 0.002 inch and 0.020 inch greater in diameter than the diameter of the filament arranged to pass therethrough.

10. Apparatus according to claim 9 in which the first aperture through which the filament is arranged to pass offers less restriction to the flow of air than the second aperture so that most of the air and liquid is arranged to be discharged in the opposite direction to the direction of travel of the filament through the device.

11. Apparatus according to claim 9 in which an extra aperture is provided through which the filament is arranged to pass before entering said previously mentioned two apertures in order to physically remove excess coolant from the filament.

12. Apparatus according to claim 11 in which the first of said previously mentioned apertures has upstream of it in the direction of travel of the filament, a hood which extends over the filament and directs any liquid delivered by said first aperture downwardly thus preventing the liquid spraying in all directions into the surrounding atmosphere.

13. Apparatus according to claim 9 in which the apertures through which the filament passes in the air wipe device are provided in a body portion of the device which is split longitudinally into two pieces in order to allow the filament to be inserted into the device.

14. Apparatus according to claim 13 in which the body portion pieces are mounted on pivoted arms which are spring biased to bring the pieces together into their operational position but which may be moved against the spring bias to open up the body portion to allow the insertion of the filament.

15. Apparatus according to claim 13 in which the body portion pieces are held in their assembled operational position by a slotted sleeve into which a length of the body portion is inserted.

16. Apparatus according to claim 9 in which the air wipe device is carried by the cooling means.

17. A cooling means for cooling a wire filament during its passage through a wire drawing machine between a die and a rotatable block, said cooling means comprising an elongated chamber through which the filament is arranged to pass whilst in a substantially straight configuration and moving in the direction of its length, said chamber being provided with nozzles arranged to direct jets of liquid coolant onto the straight moving filament and with a slot which extends longitudinally from one end of the chamber to the other, and a deformable baffle which forms part of the wall of the chamber extending across said slot, the arrangement allowing a substantially straight length of filament to be inserted into and withdrawn from the chamber through said slot by movement of said straight length relative to the chamber in a direction substantially at right angles to the longitudinal axis of said straight length thus deflecting said baffle.

18. A cooling means for cooling a wire filament during its passage through a wire drawing machine between a die and a block, said cooling means comprising an elongated chamber through which the filament is arranged to pass whilst moving in the direction of its length, said chamber being provided with nozzles arranged to direct jets of liquid coolant onto the moving filament and being provided with a slot which extends longitudinally along said chamber, a deformable baffle extending across said slot, wherein the arrangement allows a length of filament to be inserted into and withdrawn from said chamber through said slot by movement of the length of filament relative to said chamber in a direction substantially at right angles to the direction of extension of the length of filament thus deflecting said baffle.

19. Apparatus for wire drawing comprising a die, a block around which a filament leaving said die is arranged to be wrapped, cooling means located between said die and said block for cooling the filament using a liquid coolant, a wiping means between said cooling means and said block for wiping substantially all the liquid coolant from the filament before the filament passes onto said block, said cooling means comprising an elongated chamber through which the filament is arranged to pass whilst moving in the direction of its length, said chamber being provided with nozzles arranged to direct jets of the liquid coolant onto the moving filament and being provided with a slot which extends longitudinally along said chamber, a deformable baffle extending across said slot, wherein the arrangement allows a length of filament to be inserted into and withdrawn from said chamber through said slot by movement of the length of filament relative to said chamber in a direction substantially at right angles to the direction of extension of the length of filament thus deflecting said baffle.

20. A method of wire drawing wherein a metal filament is:

passed through a die and then onto a rotating block from which is passes to another element that receives wire;

cooled after leaving the die but before passing onto and being wrapped around the block, when in a straight configuration and moving rectilinearly in the direction of its length, by passing through an elongated chamber in which the filament runs through jets of liquid coolant directed at the filament, the velocity and pressure of the jets being selected to be sufficient to preclude the formation of a continuous vapor blanket around the filament which might prevent the liquid contacting the surface of the filament, the chamber being provided with a deformable but previous baffle which forms part of the wall of the chamber and restricts the exit of coolant from the chamber, and a substantially straight length of filament being inserted into and withdrawn from the chamber by deflecting the baffle;

subsequently passed through a wiping device to remove substantially all of the liquid; and passed onto the block and retained on the block so that each successive length of the filament is allowed a sufficient time to finish drying before passing to another element.

21. A method of wire drawing wherein a metal filament is:

passed through a die and then onto a block from which it passes to another element that receives wire;

cooled after leaving the die but before passing onto and being wrapped around the block and while moving in the direction of its length, by passing through an elongated chamber in which the filament runs through jets of liquid coolant directed at the filament, the velocity and pressure of the jets being selected to be sufficient to preclude the formation of a continuous vapor blanket around the filament which might prevent the liquid contacting the surface of the filament, the chamber being provided with a deformable baffle which restricts the exit of coolant from the chamber, and a substantially straight length of filament being inserted into and withdrawn from the chamber by deflecting the baffle;

subsequently passed through a wiping device to remove substantially all of the liquid; and passed onto the block and retained on the block so that each successive length of the filament is allowed a sufficient time to finish drying before passing to another element.

22. A method according to claim 20 in which said jets of coolant are directed at the filament from elongated nozzles arranged to extend parallel to the length of straight filament being cooled and disposed on opposite sides of the filament at substantially diametrically opposed positions.

* * * * *